US005732782A

United States Patent [19]

Fünfer

[11] Patent Number: 5,732,782

[45] Date of Patent: Mar. 31, 1998

[54] DRILLING AND CHISELING TOOL

[75] Inventor: Josef Fünfer, Königsbrunn, Germany

[73] Assignee: Hilti Aktiengesellschaft, Schaan, Liechtenstein

[21] Appl. No.: 730,977

[22] Filed: Oct. 16, 1996

[30] Foreign Application Priority Data

Oct. 30, 1995 [DE] Germany ..... 195 40 391.6

[51] Int. Cl.[6] ..... G23B 45/16

[52] U.S. Cl. ..... 173/104; 173/109; 173/114; 173/205

[58] Field of Search ..... 173/104, 109, 173/114, 48, 122, 205; 74/60

[56] References Cited

U.S. PATENT DOCUMENTS 4,446,931 5/1984 Bleicher et al. ..... 173/109
4,537,264 8/1985 Schmid et al. ..... 173/109
5,379,848 1/1995 Rauser ..... 173/109

FOREIGN PATENT DOCUMENTS 2110015 9/1972 Germany .
2715615 9/1978 Germany .
3506695 8/1986 Germany .

*Primary Examiner*—Joseph J. Hail, III
*Assistant Examiner*—Jay A. Stelalone
*Attorney, Agent, or Firm*—Anderson, Kill & Olick, P.C.

[57] ABSTRACT

A drilling and/or chiseling tool has a gear box housing component (2) supporting the striking mechanism (31) and an intermediate shaft (15) each having an axis with the axes arranged in parallel relation. The striking mechanism (31) and the intermediate shaft (15 are supported by a bearing plate (28) detachable connected to the gear box housing component (2).

5 Claims, 2 Drawing Sheets

DRILLING AND CHISELING TOOL

BACKGROUND OF THE INVENTION

The present invention is directed to a drilling and/or chiseling tool where a striking mechanism and an intermediate shaft are supported so that their axes are in parallel relation.

In DE-OS 35 06 695 a drilling and chiseling tool is disclosed containing a housing which is composed of a gear box housing component located closer to the leading end of the housing and a motor housing component located closer to the trailing end of the housing. Within the gear box housing component, there are two bearing supports spaced apart from one another. One of these bearing supports serves to receive a bearing region of the striking mechanism spaced from the leading end of the housing and the second bearing support is connected to a bearing for an intermediate shaft which is part of a swash mechanism with the support located closer to the leading end of the housing.

The housing of the drilling and chiseling tool is made up of two housing halves connected to one another by bolts, the housing halves being separable parallel to the axial extent of the drilling and chiseling tool. The two bearing supports are formed by bearing shells disposed in pairs relative to one another and they are connected to form one piece with the housing halves. The inner surface of the bearing shells is adapted to the outer shape of the bearing region of the striking mechanism and of the intermediate shaft.

To be able to install the striking mechanism and the intermediate shaft in the gear box housing, the housing parts of the entire housing must be separated from one another, so that the inside of the gear box housing component is freely accessible.

The fabrication of the two housing halves with the bearing shelves disposed thereon cannot be performed economically, since expensive injection tools are required, and in addition, both housing halves must be injection molded separately from one another. In order for the housing halves to fit together on assembly, they must be manufactured with considerable accuracy.

The assembly of this known drilling and chiseling tool is very time consuming, since the insertion of the individual parts into a housing half, the assembly of both housing halves and the installation of the bolts connecting the housing halves together requires considerable time.

SUMMARY OF THE INVENTION

Therefore, it is the primary object of the present invention to provide a drilling and/or chiseling tool with a striking mechanism and an intermediate shaft with their axes disposed in parallel relation and arranged so that they can be easily assembled and fabricated economically.

The striking mechanism and the intermediate shaft along with a bearing plate can be preassembled as a unit to be inserted into a gear box housing component which gear box housing component is open at both of its opposite ends. The gear box housing component is arranged to be open at both free ends with the opening in the trailing direction being larger than the opening at the leading end of the component, so that the insertion of the unit into the component is made possible by the larger trailing opening.

If the striking mechanism and the intermediate shaft are disposed offset to one another in the axial direction so that the striking mechanism projects beyond the leading end of the intermediate shaft facing in the leading or drilling direction, and the intermediate shaft extends beyond the trailing end of the striking mechanism opposite to the leading direction, the bearing plate constitutes a bearing support for a bearing region of the striking mechanism trailing in the drilling direction and for the bearing region of the intermediate shaft leading in the drilling direction. The bearing locations in the bearing plate are thus formed by two through passages extending parallel to one another and disposed spaced apart transversely of the axial or drilling direction.

The bearing plate is advantageously connected to the gear box housing component by at least one bolt. This enables the bearing plate to be fixed and removed quickly and economically from the inside of the gear box housing component.

When the drilling and/or chiseling tool is being used, heat is generated in the bearings of the striking mechanism and the intermediate shaft and preferably is diverted into the gear box housing component. Such diversion of heat is achieved with the bearing plate preferably formed of metal.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
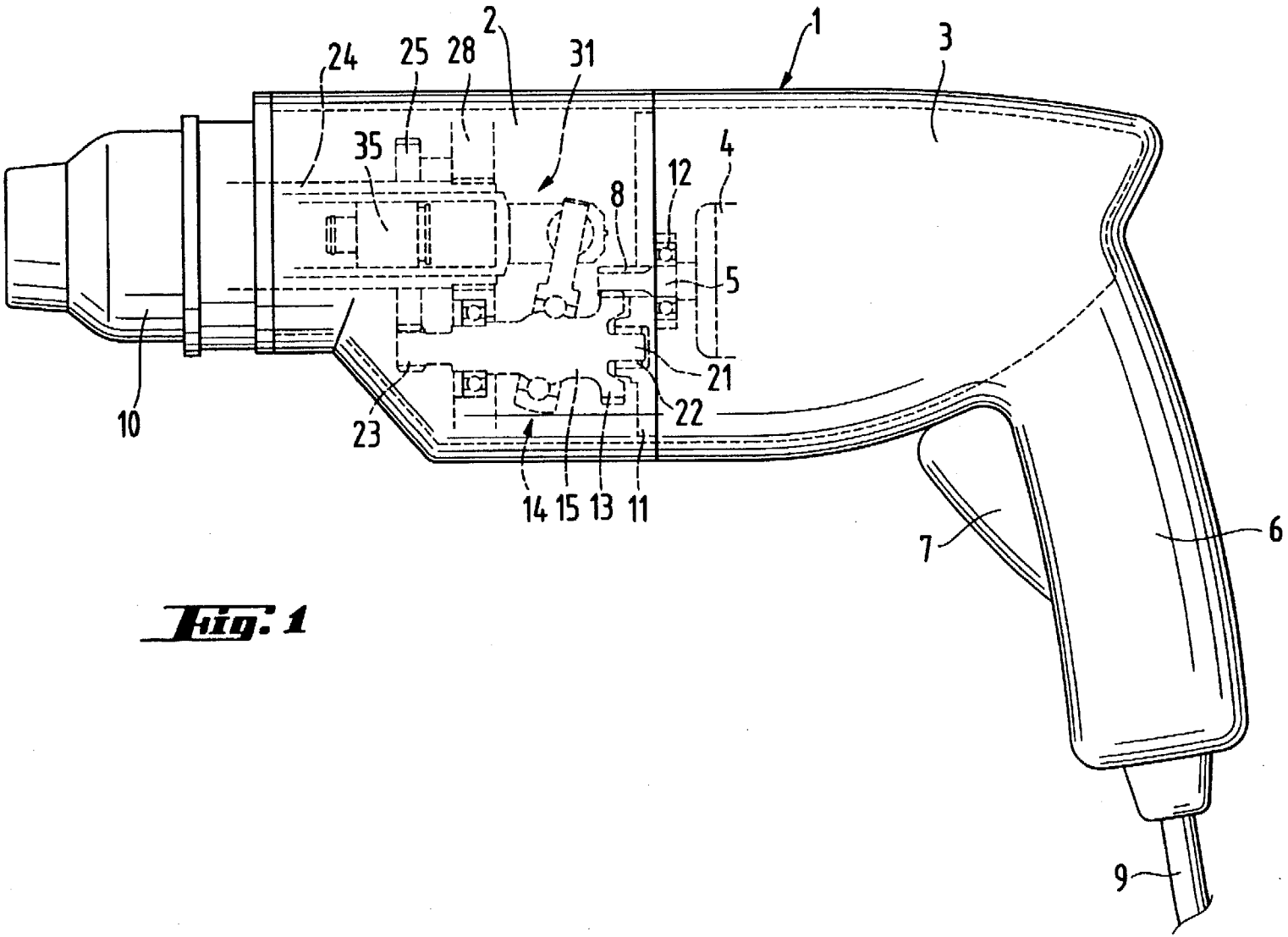
FIG. 1 is a elevational view of a drilling and chiseling tool embodying the present invention and shown diagrammatically with respect to interior operating parts.
Figure 2:
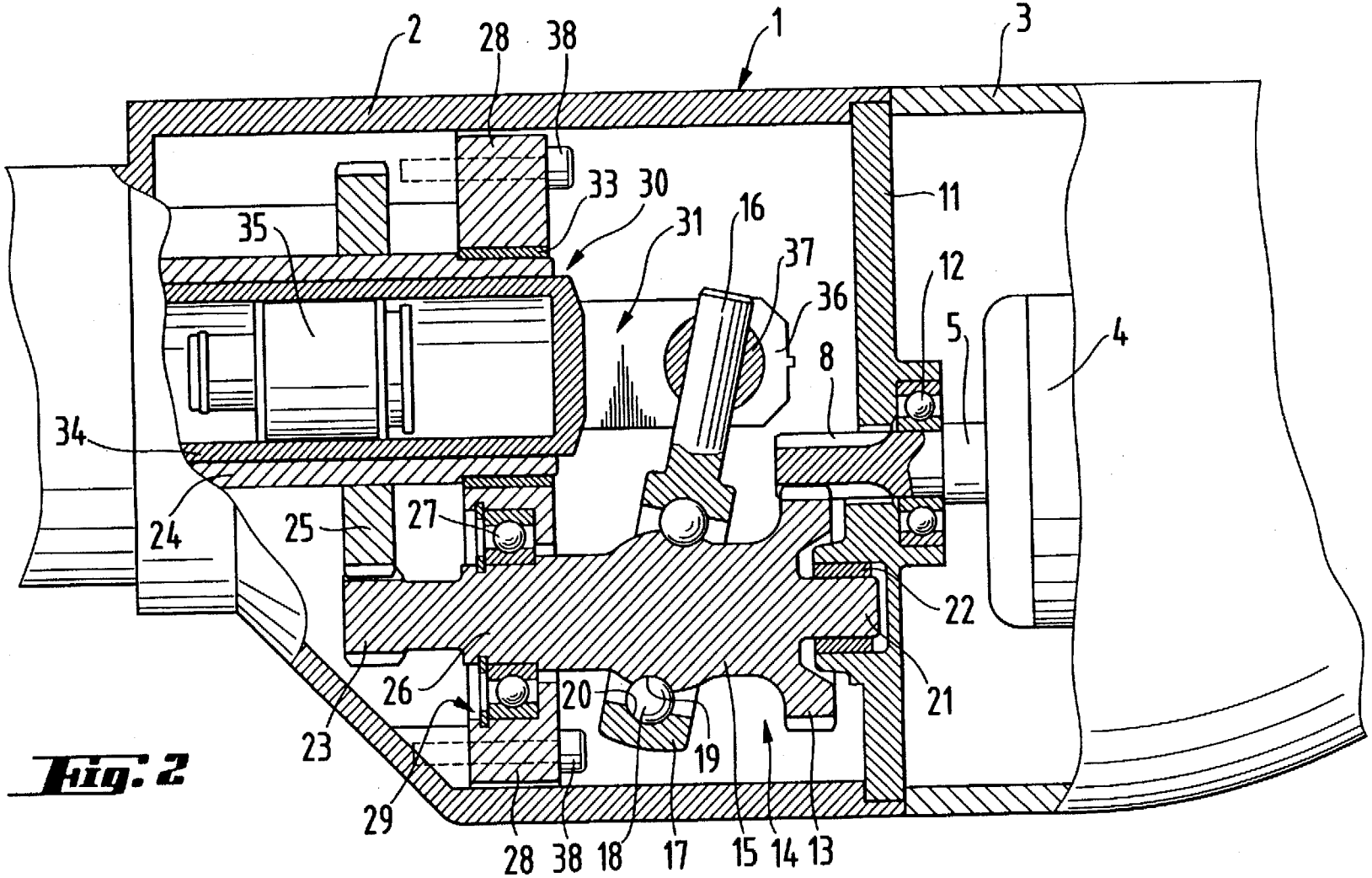
FIG. 2 is an enlarged partial elevational view of the tool shown in FIG. 1 and partly in section.

The drilling and chiseling tool illustrated in FIGS. 1 and 2 is formed of the following parts: a housing 1 having a leading end on the left and a trailing end on the right as viewed in FIG. 1 with the trailing end having a handle 6, an actuating switch 7 located in the handle 6 and a cable 9 extends from the handle to a source of power. At the leading end of the housing 1 there is a chuck 10 into which a drilling or chiseling tool bit, not shown, can be inserted. The housing 1 is formed of a gear box housing component 2 adjacent to the chuck 10 and extending from the chuck toward the trailing end and a motor housing component 3 connected to the trailing end of the gear box housing component 2 and extending to the trailing end of the housing 1. An electric drive motor 4 is located in the motor housing component 3 and can be switched on by the actuating switch 7.

The drive motor 4, as shown in FIG. 2 has a drive shaft 5 extending through an intermediate wall 11 located at the junction between the motor housing component 3 and the gear box housing component 2. The drive shaft 5 extends from the motor through the intermediate wall 11 and into the trailing end region of the gear box housing component 2. Within the intermediate wall 11, the shaft is supported by a bearing 12. At its end extending into the gear box housing component 2, the drive shaft 5 has gear teeth 8 cooperating in a positively locked manner with a drive pinion 13 of a swash mechanism 14.

The swash mechanism 14 is formed of an axially extending intermediate shaft 15, formed as a swash shaft, and supports an annular swash disk 17 with a radially extending swash lug or pin 16. The swash disk 17 encircles the intermediate shaft and is rotatably supported by balls 18 extending in the circumferential direction around the intermediate shaft 15. The balls 18 are located in circumferentially extending rolling tracks 19, 20 with the tracks being inclined to the axis of the intermediate shaft 15. One rolling track 19 is located in the intermediate shaft 15 and the other rolling track 20 is located in a through opening in the swash disk 17. The intermediate shaft has a leading end spaced from the swash disk 17 towards the leading end of the housing 1, and has a drive pinion 13 at its trailing end cooperating with the drive shaft 5 of the drive motor 4. In addition, the intermediate shaft 15 has a first bearing location 21 adjacent to and slightly rearwardly of the drive pinion 13 in form of a bearing trunnion 21 which projects into a bearing bush 22 supported in the intermediate wall 11.

An output pinion 23 is located at the leading end of the intermediate shaft 15 and cooperates in a positively locked manner with a pinion 25 connected to a tool bit spindle 24. A second bearing location 26 is arranged between the rolling track 19 and the output pinion 23 of the intermediate shaft 15 and the bearing location 26 is supported by a ball bearing 27 in a planar bearing plate 28. The bearing plate 28 extends transversely of the axial direction of the intermediate shaft 15 and a striking mechanism 31.

The bearing plate 28 located in the gear box housing component 2 has two bearing locations 29,30 in the form of through openings. The ball bearing 27 is arranged in an axially fixed manner in a first bearing location 29 of the bearing plate 28. The second bearing location 30 serves for receiving and supporting a bearing region of the striking mechanism 31 located at the trailing end of the tube-shaped tool bit spindle 24 laterally enclosing the striking mechanism 31. The tool bit spindle 24 can be rotated relative to the bearing plate 28 or to a friction bearing 33 arranged at the second bearing location 30 and it rotates relative to the striking mechanism 31.

The striking mechanism 31 is formed of axially extending cylinder 34 containing a striking piston 35 axially displaceable in the cylinder 34. The cylinder 34 is closed at its trailing end. A mobile joint 36 is located in the trailing end region of the striking mechanism 31 and includes a rotary bolt 37 extending transversely of the axial direction of the striking mechanism. The rotary bolt 37 has an opening extending perpendicularly to the axial extent of the bolt. The swash lug 16 of the swash disk 17 extends into the bore in the rotary bolt 37, so that it is axially displaceable. The cylinder 34 is coupled to the swash lug 16 so that it is axially displaceable and is rotatably locked relative to it by the mobile joint 36 and the rotary bolt 37.

The gear box housing component 2 has an opening in the leading end and an opening in the trailing end with the opening in the trailing end being larger than the opening in the leading end. The outer shape of the bearing plate 28 is matched to the larger opening, that is, the opening at the trailing end of the gear box component 2.

The tool bit spindle 24, the striking mechanism 31, the intermediate shaft 15 and the bearing plate 28 can be preassembled to form a parts unit and upon assembly the parts unit can be inserted as such into the gear box housing component 2. A bearing location, not shown, in the leading end region of the gear box housing component 2 receives the leading end region of the tool bit spindle 24. Upon placing the motor housing component 3 upon the gear box housing component 2, the bearing 12 in the intermediate wall 11 comes into engagement with the first bearing location 21 of the intermediate shaft 15 at its trailing end and the drive shaft 5 engages with its gear teeth 8 in a positively locked manner into the teeth of the drive pinion 13 on the intermediate shaft 15. The bearing plate 28 is fixed in the axial direction within the gear box housing 2 by means of bolts 38 projecting through openings in the bearing plate 28 and extending into threaded bores, not shown, in the gear box housing component 2.

While specific embodiments of the invention have been shown and described in detail to illustrate the inventive principles, it will be understood that the invention may be embodied otherwise without departing from such principles.

I claim:

1. A drilling and/or chiseling tool comprises a housing having a leading end and a trailing end, a chuck (10) is located at the leading end of said housing for receiving a bit, said housing comprising a gear box housing component (2) adjacent said chuck and having a leading end and a trailing end, a striking mechanism (31) and an intermediate shaft (15) are supported within said gear box housing component (2) and each has an axis extending in the trailing end-leading end direction of the housing with said axes thereof arranged in parallel relation, and a planar bearing plate (28) extending transversely of said axes is detachably connected to said gear box housing component (2) between and spaced from the leading end and trailing end of said housing component (2).

2. A drilling and/or chiseling tool, as set forth in claim 1, wherein said bearing plate (28) forms a bearing location (30) for a bearing region of said striking mechanism (31) located at a trailing end of said striking mechanism.

3. A drilling and/or chiseling tool, as set forth in claims 1 or 2, wherein said bearing plate (28) forms a bearing location (29) for a bearing region (26) of said intermediate shaft (15) located adjacent a leading end of said intermediate shaft.

4. A drilling and/or chiseling tool, as set forth in claim 3, wherein said bearing plate (28) is connected to said gear box housing component (2) by at least one bolt extending into a threaded opening in said gear box housing component.

5. A drilling and/or chiseling tool, as set forth in claims 1 or 2 wherein said bearing plate (28) is formed of metal.

* * * * *